United States Patent [19]

Henzel et al.

[11] Patent Number: 4,965,241

[45] Date of Patent: Oct. 23, 1990

[54] THERMAL DYE TRANSFER RECEIVING ELEMENT WITH SUBBING LAYER FOR DYE IMAGE-RECEIVING LAYER

[75] Inventors: Richard P. Henzel, Webster; Daniel J. Harrison, Rochester, both of N.Y.

[73] Assignee: Eastman Kodak Company, Rochester, N.Y.

[21] Appl. No.: 449,631

[22] Filed: Dec. 11, 1989

[51] Int. Cl.[5] ..... B41M 5/035; B41M 5/26

[52] U.S. Cl. ..... 503/227; 8/471; 428/195; 428/412; 428/447; 428/448; 428/523; 428/913; 428/914

[58] Field of Search ..... 8/471; 428/195, 412, 428/447, 448, 523, 913, 914; 503/227

[56] References Cited

U.S. PATENT DOCUMENTS

| | | | |
|---|---|---|---|
| 4,626,256 | 12/1986 | Kawasaki | 8/471 |
| 4,720,480 | 1/1988 | Ito et al. | 503/227 |
| 4,737,486 | 4/1988 | Henzel | 503/227 |
| 4,748,150 | 5/1988 | Vanier et al. | 503/227 |
| 4,774,224 | 9/1988 | Campbell | 503/227 |
| 4,814,321 | 3/1989 | Campbell | 503/227 |

*Primary Examiner*—Bruce H. Hess

*Attorney, Agent, or Firm*—Andrew J. Anderson

[57] ABSTRACT

A dye-receiving element for thermal dye transfer includes a polyolefin support, a polymeric dye image-receiving layer, and a polymeric subbing layer having a silicon oxide backbone and amino-functional substituents between the polyolefin support and the dye image-receiving layer which provides improved adhesion.

20 Claims, No Drawings

THERMAL DYE TRANSFER RECEIVING ELEMENT WITH SUBBING LAYER FOR DYE IMAGE-RECEIVING LAYER

This invention relates to dye-receiving elements used in thermal dye transfer, and more particularly to the use of a subbing layer between the support and a polymeric dye image-receiving layer to improve the adhesion of the dye image-receiving layer to the support.

In recent years, thermal transfer systems have been developed to obtain prints from pictures which have been generated electronically from a color video camera. According to one way of obtaining such prints, an electronic picture is first subjected to color separation by color filters. The respective color separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

U S. Pat. No. 4,774,224 and No. 4,814,321 of Campbell and No. 4.748,150 of Vanier et al disclose dye-receiving elements for thermal dye transfer comprising polyethylene coated supports having thereon a subbing layer of a vinylidene chloride copolymer and a polymeric dye image-receiving layer.

While the use of such vinylidene chloride copolymer subbing layers improves the adhesion of the dye image-receiving layer to polyethylene coated supports, it has been found that adhesion to other polyolefins such as polypropylene is not as good. Also, even in the case of polyethylene, in some instances where the use of vinylidene chloride copolymers gives apparently acceptable initial adhesion, adhesion after thermal transfer of a dye image is poor.

U.S. Pat. No. 4,737,486 of Henzel discloses the use of N-(2-aminoethyl)-3-aminopropyltrimethoxysilane and 3-aminopropyltriethoxysilane as subbing layers in a dye-donor element, but does not suggest the need for or use of such compounds as a subbing layer in a dye-receiving element.

It would be desirable to provide a thermal dye transfer dye-receiving element which would have good adhesion between a polymeric dye image-receiving layer and polyolefin coated supports, including both polyethylene and polypropylene coated supports, and good adhesion both before and after being subjected to a thermal printing process.

These and other objects are achieved in accordance with this invention which comprises a dye-receiving element for thermal dye transfer comprising a polyolefin support and having thereon a subbing layer comprising a polymer having a silicon oxide backbone and at least one aminofunctional substituent, and a polymeric dye image-receiving layer.

In a preferred embodiment of the invention, the subbing layer polymer is formed from an aminofunctional organo-oxysilane. For the purpose of this invention, "organo-oxysilane" is defined as $X_{4-m}Si(OR)_m$ where X and R represent substituted or unsubstituted hydrocarbon substituents, and m equals 1, 2 or 3. "Aminofunctional organo-oxysilane" is defined as an organo-oxysilane as set forth above wherein at least one X substituent contains a terminal or internal amine function. Such compounds are commercially available, and may be prepared by conventional techniques.

The organo-oxysilanes of the invention are believed to undergo hydrolysis at varying rates to form the silicon oxide backbone polymeric subbing layers.

In a further preferred embodiment of the invention, the aminofunctional organo-oxysilane is of the following formula:

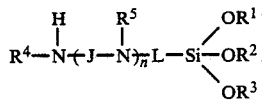

wherein $R^1$, $R^2$ and $R^3$ are each independently selected from the group consisting of substituted or unsubstituted $C_1$ to $C_{10}$ alkyl, $C_5$ to $C_{10}$ aryl, and $C_5$ to $C_{10}$ carbocyclic; $R^4$ and $R^5$ are each independently hydrogen or selected from the above alkyl, aryl and carbocyclic group; J and L are each hydrocarbon linking moieties of from 1 to 12 carbon atoms; and n is 0 or a positive integer up to 6. Examples of J and L linking moieties are $—CH_2—$, $—CH(CH_3)—$ and $—C_6H_4—$, and combinations thereof.

In a preferred embodiment, J and L are $—C_xH_{2x}—$ linking moieties of from 1 to 10 carbon atoms; $R^1$, $R^2$ and $R^3$ are each alkyl groups; and n is 0, 1 or 2. Specific examples of such amino functional organo-oxysilanes are 3 -aminopropyl triethoxysilane (commercially available as product 11,339-5 of Aldrich Chem. Co.), N-(2-aminoethyl)-3-aminopropyltrimethoxysilane (commercially available as product Z-6020 of Dow Corning Co.), and trimethoxysilylpropyldiethylenetriamine (commercially available as product T-2910 of Petrarch Systems, Inc.).

The aminofunctional silicon oxide backbone polymeric subbing layer of the invention may be employed at any concentration which is effective for the intended purpose. In general, good results have been obtained at from about 0.005 to about 0.5 g/m$^2$ of the coated aminofunctional organo-oxysilane, preferably from about 0.02 to about 0.5 g/m$^2$, and the most preferred range is from about 0.05 to about 0.3 g/m$^2$.

The polymeric dye image-receiving layer of the dye-receiving element of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

In a preferred embodiment of the invention, the dye image-receiving layer is a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis-(oxyphenyl)butane, 1,1-bis(oxyphenyl)cyclohexane, 2,2-bis(oxyphenyl)butane, etc.

In another preferred embodiment of the invention, the polycarbonate dye image-receiving layer is a bisphenol-A polycarbonate having a number average molecular weight of at least about 25,000. In still another preferred embodiment of the invention, the bisphenol-A polycarbonate comprises recurring units having the formula

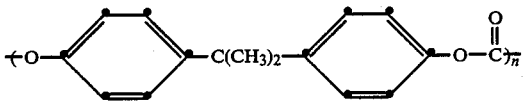

wherein n is from about 100 to about 500.

Examples of such polycarbonates include General Electric Lexan® Polycarbonate Resin #ML-4735 (Number average molecular weight app. 36,000), and Bayer AG Makrolon #5705® (Number average molecular weight app. 58,000). The later material has a $T_g$ of 150° C.

The polyolefin support for the dye-receiving element of the invention may comprise a polyolefin monolayer, or may comprise a substrate bearing a polyolefin layer. In a preferred embodiment, a paper substrate support bearing a polypropylene containing layer is used. In a further preferred embodiment, a paper substrate support bearing a layer comprising a mixture of polypropylene and polyethylene is used. Such supports are the subject matter of copending, commonly assigned U.S. Ser. No. 449,630 of Mruk et al., filed Dec. 11, 1989, the disclosure of which is incorporated by reference. The polyolefin layer on the paper support is generally applied at about 10 to about 100 g/m$^2$, preferably about 20 to about 50 g/m$^2$. Synthetic supports having a polyolefin layer may also be used. Preferably, the polyolefin layer of the support is subjected to corona discharge treatment prior to being coated with the subbing layer of the invention.

The corona discharge treatment that is used for the polyolefin support can be carried out in an apparatus such as described in U.S. Pat. Nos. 2,864,755, 2,864,756, 2,910,723 and 3,018,189. Advantageously, the polyolefin support is subjected to a corona discharge of from about 0.1 to about 3.5 rfa. For example, a 60 -cycle Lepel high frequency generator operating at 6 kva. at 440 volts giving an output of 2.5 RF amps can be used with several metal electrodes close to the support at a point where it passes over a metal roll coated with a dielectric material. Similarly, a metal roller may be used to support the web with the other electrode array being in planetary disposition equidistant from the surface of the metal roller and each being coated with a dielectric at least on the surface nearest the metal roller. For further details, reference is made to U.S. Pat. No. 3,412,908, the disclosure of which is hereby incorporated by reference.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

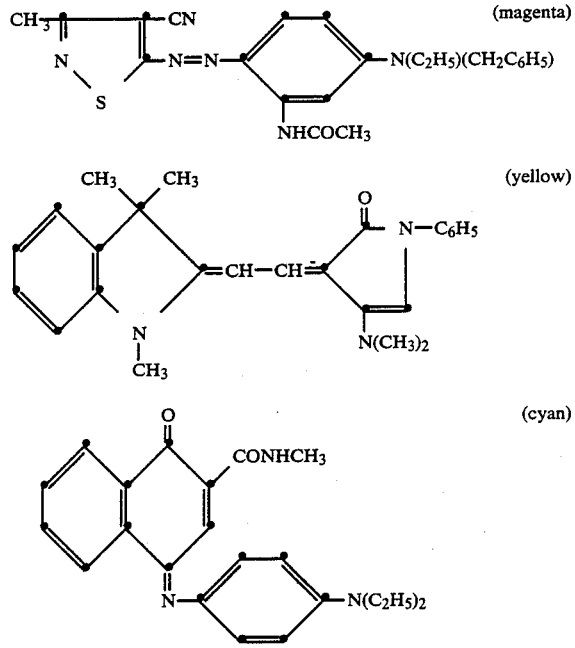

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a Poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide amides and polyether imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in U.S. Pat. No. 4,700,208 of Vanier et al, issued Oct. 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly(vinyl alcohol co butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises imagewise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH$_7$-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention, wherein:

Silane 1: $H_2N(CH_2)_3Si(OC_2H_5)3$ (3-aminopropyltriethoxysilane)

Silane 2: $H_2N(CH_2)_2NH(CH_2)_3Si(OCH_3)_3$ (N-(2-aminoethyl)-3-aminopropyltrimethoxysilane)

Silane 3: $H_2N(CH_2)_2NH(CH_2)_2NH(CH_2)_3Si(OCH_3)_3$ (trimethoxysilylpropyldiethylenetriamine)

EXAMPLE 1

This example shows that the aminofunctionalized organo-oxysilanes of the invention form superior subbing layers for polyolefin to polycarbonate interfaces compared to prior art vinylidene chloride polymer subbing layers.

Two different polyolefin paper supports were used for dye-transfer receivers, one was polyethylene derived, the other predominately polypropylene containing 20% polyethylene.

A 5.3 mil (135 μm) thick paper stock mixture of hardwood and softwood bleached pulp was extrusion overcoated by methods well-known in the art with either a blend of high and low density polyethylene pigmented with 9% titanium dioxide at a total layer coverage of 17 g/m$^2$ (thickness 19 μm) or with a blend of 20% low density polyethylene, 75% crystalline polypropylene, and 5% Penn. Ind. Chem. Piccotex 120 (copolymer of α-methyl styrene, m-vinyltoluene, and p-vinyl-toluene) pigmented with 9% titanium dioxide at a total layer coverage of 44 g/m$^2$ (thickness 50 μm).

An aminofunctional organo-oxysilane of the invention was coated at the indicated level from a ethanol-water solvent mixture on top of each of the polyethylene (PE) or polypropylene-derived (PP) paper supports. Before each subbing layer was coated, the support was subjected to corona discharge treatment at approximately 450 joules/m$^2$. On top of each subbing layer a dye-receiving layer of Bayer AG:Makrolon 5700 (a bisphenol A-polycarbonate) (3.2 g/m$^2$), 3M Corp.:FC-431 (a perfluorinated alkylsulfonamidoalkyl ester) (0.022 g/m$^2$), Dow Corning:DC-510 Silicone Fluid (0.016 g/m$^2$), di-n-butylphthalate (0.32 g/m$^2$), and diphenylphthalate (0.32 g/m$^2$) was coated from methylene chloride.

A comparison subbing layer (C-2) of poly(acrylonitrile-co-vinylidene chloride-co-acrylic acid) (14/79/7 wt ratio) was coated as described above from a butanone and cyclopentanone solvent mixture.

Each receiver was subjected to a tape adhesion test. The receiver surface was first carefully scored in an "X" pattern. A small area (approximately ¾ inch×2 inch) of 3M Corp. Scotch® Magic Transparent Tape was firmly pressed by hand over the scored area of the receiver surface leaving enough area free to serve as a handle for pulling the tape. Upon manually pulling the tape, ideally none of the receiver layer would be removed. Receiver layer removal indicated a weak bond between the polyolefin coated paper support and the receiver layer.

The tape test was repeated on the same area if necessary. Receivers that appeared to show excellent adhesion on the as coated material were subjected to a thermal printing process using separate cyan, magenta and yellow dye-donors and were again subjected to the tape test described above. In some instances comparison materials that had apparently acceptable initial adhesion, failed the adhesion test after printing.

The following categories were established:

E—excellent (no layer removal even after repeated tries with the tape test—in some instances subbing layer bond may be so strong that tearing occurs at paper-/olefin interface)

F—fair (partial layer removal)

P—poor or unacceptable (substantial or total layer removal)

The data below show that the amino functional organo-oxysilanes cf the invention gave improved adhesive characteristics when used at 0.02 to 0.5 g/m$^2$ as a subbing layer for polyethylene or polypropylene derived supports overcoated with a polycarbonate dye-receiving layer compared to the prior art subbing layer over the same coverages.

While the tape test after printing for the receiver elements with a polyethylene coated support and vinylidene chloride copolymer comparison subbing layer (C-2) indicated poor adhesion in this test, this subbing layer gave excellent results after printing in other tests run under the same conditions, with the exception that the receivers did not contain di-n-butylphthalate or diphenylphthalate, at a subbing layer concentration of 0.16 g/m$^2$. The consistency of the excellent results achieved with the aminofunctional organo-oxysilane derived subbing layers of the invention is a further advantage over the vinylidene chloride copolymer's variable results.

| Subbing Layer | | Support | Tape Test Initial | Tape Test After Printing |
|---|---|---|---|---|
| None (control) (C-1) | — | PE | P | nd |
| Vinylidene chloride polymer (C-2) | (0.005 g/m$^2$) | PE | P | P |
| Vinylidene chloride polymer (C-2) | (0.022 g/m$^2$) | PE | P | P |
| Vinylidene chloride polymer (C-2) | (0.054 g/m$^2$) | PE | E | P |
| Vinylidene chloride polymer (C-2) | (0.16 g/m$^2$) | PE | E | P |
| Vinylidene chloride polymer (C-2) | (0.32 g/m$^2$) | PE | E | P |
| Vinylidene chloride polymer (C-2) | (0.54 g/m$^2$) | PE | E | P |
| Silane 2 | (0.005 g/m$^2$) | PE | P | P |
| Silane 2 | (0.022 g/m$^2$) | PE | E | E |
| Silane 2 | (0.054 g/m$^2$) | PE | E | E |
| Silane 2 | (0.16 g/m$^2$) | PE | E | E |
| Silane 2 | (0.32 g/m$^2$) | PE | E | E |
| Silane 2 | (0.54 g/m$^2$) | PE | E | E |
| None (control) (C-1) | — | PP | P | nd |
| Vinylidene chloride polymer (C-2) | (0.005 g/m$^2$) | PP | F | nd |
| Vinylidene chloride polymer (C-2) | (0.022 g/m$^2$) | PP | P | nd |
| Vinylidene chloride polymer (C-2) | (0.054 g/m$^2$) | PP | P | nd |
| Vinylidene chloride polymer (C-2) | (0.16 g/m$^2$) | PP | P | nd |
| Vinylidene chloride polymer (C-2) | (0.32 g/m$^2$) | PP | P | nd |
| Vinylidene chloride polymer (C-2) | (0.54 g/m$^2$) | PP | P | nd |
| Silane 2 | (0.005 g/m$^2$) | PP | E | nd |
| Silane 2 | (0.022 g/m$^2$) | PP | E | nd |
| Silane 2 | (0.054 g/m$^2$) | PP | E | nd |
| Silane 2 | (0.16 g/m$^2$) | PP | E | nd |
| Silane 2 | (0.32 g/m$^2$) | PP | E | nd |
| Silane 2 | (0.54 g/m$^2$) | PP | E | nd |

nd - not determined

EXAMPLE 2

This example is similar to Example 1 and shows that if the organo-oxysilane is not aminofunctionalized, the resulting subbing layer is not particularly effective.

Dye-transfer receivers on either polyethylene (PE) or polypropylene-derived (PP) supports were prepared with the indicated invention or control subbing layer and overcoated with a polycarbonate dye-receiving layer as described in Example 1 except the receivers did not contain di-n-butylphthalate or diphenylphthalate, and had 2.9 g/m$^2$ of the polycarbonate. All subbing layers were overcoated at 0.22 g/m$^2$. The same tape-test was used as in Example 1. All the silanes coated as subbing layers contained the equivalent of 0.001 mg/m$^2$ acetic acid.

The following comparison materials were evaluated:

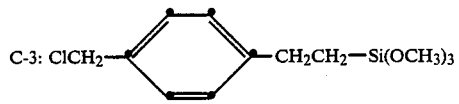

C-4: $(C_2H_5)_2(PO)CH_2CH_2—Si(OC_2H_5)_3$

C-5: $(Cl(CH_2)_3—Si(OCH_3)_3$

C-6: $CH_2{=}CH—Si(OC_2H_5)_3$

C-7: $CH_2{=}C(CH_3)CO_2(CH_2)_3—Si(OCH_3)_3$

C-8: $HS(CH_2)_3—Si(OCH_3)_3$

C-9: 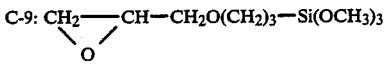

C-10: $H_2NCONHCH_2CH_2CH_2Si(OCH_3)_3$
C-11: $OCN—(CH_2)_3—Si(OC_2H_5)_3$
C-12: $CH_2{=}CH—Si(O_2CCH_3)_3$
C-13: $(CH_3)_3Si—NH—Si(CH_3)_3$

The data below show that unless the organo-oxysilane has a functionalized amino group, the resulting subbing layer is not as effective.

| Subbing Layer | Support | Tape Test (Initial) |
|---|---|---|
| None (control) | PE | P |
| Benzyl chloride silane (C-3) | PE | P |
| Phosphate silane (C-4) | PE | P |
| Chloroalkyl silane (C-5) | PE | P |
| Vinyl silane (C-6) | PE | P |
| Methacryloyl silane (C-7) | PE | P |
| Mercaptoalkyl silane (C-8) | PE | P |
| Epoxy silane (C-9) | PE | P |
| Ureido silane (C-10) | PE | P |
| Isocyanato silane (C-11) | PE | P |
| Vinyl (triacetoxy) silane (C-12) | PE | P |
| Hexamethyl disilizane (C-13) | PE | P |
| Silane 1 | PE | E |
| Silane 2 | PE | E |
| Silane 3 | PE | E |
| None (control) | PP | P |
| Benzyl chloride silane (C-3) | PP | P |
| Phosphate silane (C-4) | PP | P |
| Chloroalkyl silane (C-5) | PP | P |
| Vinyl silane (C-6) | PP | P |
| Methacryloyl silane (C-7) | PP | P |
| Mercaptoalkyl silane (C-8) | PP | P |
| Epoxy silane (C-9) | PP | P |
| Ureido silane (C-10) | PP | P |
| Isocyanato silane (C-11) | PP | P |
| Vinyl (triacetoxy) silane (C-12) | PP | P |
| Hexamethyl disilizane (C-13) | PP | P |
| Silane 1 | PP | E |
| Silane 2 | PP | E |
| Silane 3 | PP | E |

EXAMPLE 3

This example is similar to Example 2 but shows that aminofunctional organo-oxysilane derived subbing layers also are effective when the dye-receiving layer polymer is an ester or vinyl chloride polymer.

Dye-transfer receivers on polypropylene derived (PP) supports were prepared with either an aminofunctional organo-oxysilane (0.16 g/m$^2$) of the invention, a polyvinylidene chloride derived prior art polymer (0.16 g/m$^2$), or no polymer as a subbing layer. Three receiving layer polymers were coated each at 3.2 g/m$^2$ from methylene chloride over the indicated subbing layer.

Receiver polymer 1:

A bisphenol-A polycarbonate modified with 50 mole % to 3-oxa-1,5-pentanediol (Tg=74°)

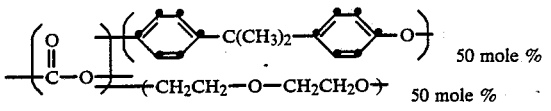

Receiver polymer 2:

Toyobo KK, Vylon 200 Synthetic polyester resin

Receiver polymer 3:

Scientific polymer products Inc., No. 070

A vinyl chloride vinylacetate-maleic acid copolymer (81:17:2 weight ratio)

Each dye-receiving layer also contained 3M Corp.:FC-431 (a perfluorinated alkyl sulfonamide alkyl ester) (0.022 g/m$^2$) and Dow Corning:DC-510 Silicone Fluid (0.016 g/m$^2$).

The same tape test was used as in Example 1.

The data below show that the aminofunctional organo-oxysilane derived subbing layer of the invention is effective between polyolefin layers and dye-receiving layers other than polycarbonates.

| Subbing Layer | Receiver Polymer | Tape Test |
|---|---|---|
| None (control) (C-1) | 1 | P |
| Vinylidene chloride polymer (C-2) | 1 | P |
| Silane 2 | 1 | E |
| None (control) (C-1) | 2 | P |
| Vinylidene chloride polymer (C-2) | 2 | P |
| Silane 2 | 2 | E |
| None (control) (C-1) | 3 | P |
| Vinylidene chloride polymer (C-2) | 3 | P |
| Silane 2 | 3 | E |

The above results demonstrate the effectiveness of aminofunctional organo-oxysilane derived subbing layers in bonding dye image-receiving layers to polyolefin supports, especially supports bearing a polypropylene containing layer, and the effectiveness of such subbing layers both before and after the dye-receiving element is subjected to a thermal printing process.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising:

(a) a polyolefin support;

(b) a polymeric dye image-receiving layer; and (c) a subbing layer between said polyolefin support and said dye image-receiving layer, the improvement wherein said subbing layer comprises a polymer having a silicon oxide backbone and at least one aminofunctional substituent.

2. The element of claim 1, wherein the support comprises a substrate bearing a polypropylene containing layer.

3. The element of claim 1, wherein the dye-receiving layer comprises a polycarbonate.

4. The element of claim 1, wherein the dye image-receiving layer contains a thermally-transferred dye image.

5. The element of claim 1, wherein the subbing layer polymer is formed from an amino-functional organo-oxysilane.

6. The element of claim 5, wherein the aminofunctional organo-oxysilane is of the following structure:

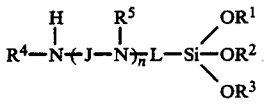

wherein $R^1$, $R^2$ and $R^3$ are each independently selected from the group consisting of substituted or unsubstituted $C_1$ to $C_{10}$ alkyl, $C_5$ to $C_{10}$ aryl, and $C_5$ to $C_{10}$ carbocyclic; $R^4$ and $R^5$ are each independently hydrogen or selected from the above alkyl, aryl and carbocyclic group; J and L are each hydrocarbon linking moieties of from 1 to 12 carbon atoms; and n is 0 or a positive integer up to 6.

7. The element of claim 6, wherein each J and L is selected from the group consisting of $—C_xH_{2x}—$ linking moieties of from 1 to 10 carbon atoms; $R^1$, $R^2$ and $R^3$ are each alkyl groups; and n is 0, 1 or 2.

8. The element of claim 7, wherein the aminofunctional organo-oxysilane is 3-aminopropyltriethoxysilane.

9. The element of claim 7, wherein the aminofunctional organo-oxysilane is N-(2-amino ethyl)-3-aminopropyltrimethoxysilane.

10. The element of claim 7, wherein the aminofunctional organo-oxysilane is trimethoxysilylpropyldiethylenetriamine.

11. The element of claim 7, wherein the support comprises a substrate bearing a polypropylene containing layer.

12. The element of claim 7, wherein the dye-receiving layer comprises a polycarbonate.

13. The element of claim 7, wherein the dye image-receiving layer contains a thermally-transferred dye image.

14. In a process of forming a dye transfer image comprising imagewise heating a dye-donor element comprising a support having thereon a dye-containing layer and thereby transferring a dye image to a dye-receiving element to form said dye transfer image, said dye-receiving element comprising a polyolefin support having thereon a polymeric dye image-receiving layer and a subbing layer between said polyolefin support and said dye image-receiving layer, the improvement wherein said subbing layer comprises a polymer having a silicon oxide backbone and at least one aminofunctional substituent.

15. The process of claim 14, wherein the subbing layer polymer is formed from an aminofunctional organo-oxysilane of the following structure:

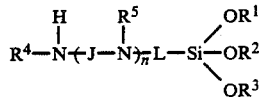

wherein $R^1$, $R^2$ and $R^3$ are each independently selected from the group consisting of substituted or unsubstituted $C_1$ to $C_{10}$ alkyl, $C_5$ to $C_{10}$ aryl, and $C_5$ to $C_{10}$ carbocyclic; $R^4$ and $R^5$ are each independently hydrogen or selected from the above alkyl, aryl and carbocyclic group; J and L are each hydrocarbon linking moieties of from 1 to 12 carbon atoms; and n is 0 or a positive integer up to 6.

16. The process of claim 15, wherein the dye-receiving element support comprises a substrate bearing a polypropylene containing layer.

17. The process of claim 15, wherein the dye image-receiving layer comprises a polycarbonate.

18. The process of claim 15, wherein each J and L are selected from the group consisting of $—C_xH_{2x}—$ linking moieties of from 1 to 10 carbon atoms; $R^1$, $R^2$ and $R^3$ are each alkyl groups; and n is 0, 1 or 2.

19. In a thermal dye transfer assemblage comprising:

(a) a dye-donor element comprising a support having thereon a dye-containing layer; and (b) a dye-receiving element comprising (i) a polyolefin support, (ii) a polymeric dye image-receiving layer, and (iii) a subbing layer between the polyolefin support and the dye image-receiving layer, said dye-receiving element being in a superposed relationship with said dye-donor element so that said dye-containing layer is in contact with said dye image-receiving layer, the improvement wherein said subbing layer comprises a polymer having a silicon oxide backbone and at least one aminofunctional substituent.

20. The assemblage of claim 19, wherein the subbing layer polymer is formed from an aminofunctional organo-oxysilane of the following structure:

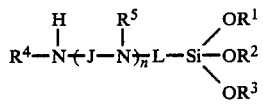

wherein $R^1$, $R^2$ and $R^3$ are each independently selected from the group consisting of substituted or unsubstituted $C_1$ to $C_{10}$ alkyl, $C_5$ to $C_{10}$ aryl, and $C_5$ to $C_{10}$ carbocyclic; $R^4$ and $R^5$ are each independently hydrogen or selected from the above alkyl, aryl and carbocyclic group; J and L are each hydrocarbon linking moieties of from 1 to 12 carbon atoms; and n is 0 or a positive integer up to 6.

* * * * *